US007490721B2

(12) United States Patent
Bishop

(10) Patent No.: US 7,490,721 B2
(45) Date of Patent: Feb. 17, 2009

(54) CAMERA HOLDER

(76) Inventor: J. Scott Bishop, 811 Niantic Ct., San Diego, CA (US) 92109

( * ) Notice: Subject to any disclaimer, the term of this patent is extended or adjusted under 35 U.S.C. 154(b) by 113 days.

(21) Appl. No.: 11/784,371

(22) Filed: Apr. 5, 2007

(65) Prior Publication Data

US 2007/0295625 A1 Dec. 27, 2007

Related U.S. Application Data

(60) Provisional application No. 60/816,429, filed on Jun. 26, 2006.

(51) Int. Cl.
*B65D 85/38* (2006.01)

(52) U.S. Cl. ..... 206/316.2; 206/320; 224/908

(58) Field of Classification Search ... 206/316.1–316.3, 206/37, 305, 320; 150/154; 224/908–910, 224/930

See application file for complete search history.

(56) References Cited

U.S. PATENT DOCUMENTS 3,813,017 A * 5/1974 Pimsleur ..... 206/316.2
4,714,184 A 12/1987 Young et al.
4,907,792 A 3/1990 Hess, III
5,014,892 A 5/1991 Copeland
5,653,336 A 8/1997 Buonaiuto
5,797,683 A 8/1998 Gunzi et al.
D413,435 S 9/1999 Chapman et al.
6,568,576 B1 * 5/2003 Godshaw et al. ..... 224/930
6,698,636 B2 3/2004 Angus et al.
6,913,176 B1 7/2005 Buscemi
2004/0226836 A1 * 11/2004 Schreiber et al. ..... 206/320
2007/0228099 A1 * 10/2007 Beda ..... 224/930

* cited by examiner

*Primary Examiner*—Luan K Bui
(74) *Attorney, Agent, or Firm*—Donn K. Harms

(57) ABSTRACT

A camera storage apparatus adapted for engagement to a user having a case formed by two elastically engaged sidewalls. An aperture provides access for the camera to an interior cavity and a projection creates a restraint for the camera while in the interior cavity. The elastic edgewall may be stretched by the user to remove or insert the camera into the interior cavity past the projection. A lip extending past the aperture and over the body of the user provides a guide for the camera into the interior cavity so the user need not look at the device during insertion and removal of the camera.

20 Claims, 1 Drawing Sheet

CAMERA

CAMERA HOLDER

This application claims priority from U.S. Provisional Patent Application Ser. No. 60/816,429 filed Jun. 26, 2006.

FIELD OF THE INVENTION

The invention herein disclosed and described relates to a camera case. More particularly it relates to a clothing engageable camera case adapted for use in an aquatic venue such as at the beach when the user is surfing. The device features a unique biased sidewall and rib closure adjacent to an entry aperture to provide for quick removal and replacement of a camera therein.

BACKGROUND OF THE INVENTION

In recent years, digital photography and film photography have evolved to include inexpensive water proof cameras which have a cost and ease of use factor within the scope of everyday users. Where formally such waterproof cameras were bulky and expensive and hard to operate, placing them in the domain of professionals, recently developed digital cameras with computerized exposure calculations have made water related photography well within the scope of operation of amateurs.

However, frequently in water sports the force of the water itself is a factor in why the user is in the aquatic environment. This is especially true in the sport of surfing, kayaking, rafting, and sports where the user is essentially riding the water on a craft of some sort.

In such an environment, there will generally be short time periods between rushing water or breaking waves where the user has the opportunity to snap a photograph. In doing so, the user currently must either hold the camera in their hand for the duration of the time in the water, or place it in some belt mounted or body mounted casing when it is not being used so the camera may ride along with the user.

Most such cases and camera holders are inconvenient for the user since they employ lids to hold the camera in a confined area. Further, in the very short time frames available to the user, removing the camera from the camera bag or holder, taking the picture, and fumbling to replace the camera in the holder is very inconvenient. Consequently, most users take very few pictures especially in a surfing environment where the user is liable to end up underneath the wave, instead of upon it, should they mis-time their actions due to fumbling with their camera.

As such, there exists an unmet need for a device which will engage and hold a camera in a water environment and which will allow ease of use. Such a device should provide a very secure containment of the camera so that in the rough and tumble marine environment the camera is not lost. However, such a device should also allow for the easy insertion and removal of the camera from the case, so that the user may employ the camera in very short available time frames. Still further, such a device should allow for removal and reinsertion into a casing, in a manner that does not require the user to look at the device during either action. This allows the user to keep their eyes on the moving water so they can make timely moves and take immediate action should the need arise, without having to look at the camera holder to re-insert the camera therein.

Still further, such a device should additionally allow the user to snap pictures, if desired, without the need to remove the camera from the body-engaged camera holder.

It is an object of this invention to provide a device for the containment of a camera which is engageable to the user.

It is a further object to provide a device wherein during removal and especially reinsertion of the camera in the case the user may easily do so without having to look at or view the opening the case.

It is an additional object of this invention to provide such a camera holder that is especially well adapted for use in a marine environment in combination with water resistant cameras.

It is an additional object of this invention to provide such a device that is adapted for engagement to a wet suit or other marine type article of clothing.

It is a further object of this invention to provide such a camera holder that will allow the user to take photos without removing it from the case which is user-engaged.

The foregoing has outlined some of the more pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings wherein the detailed description is for the purpose of fully disclosing the invention without placing limitations thereon.

With respect to the above description and background, before explaining at least one preferred embodiment of the invention in detail, it is to be understood that the invention is not limited in its application to the details of construction and to the arrangement of the components and/or steps set forth in the following description or illustrated in the drawings. The various apparatus and methods of the invention herein described and disclosed are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other devices, methods and systems for carrying out the several purposes of the present disclosed device for holding a camera. It is important, therefore, that the objects and claims be regarded as including such equivalent construction and methodology, insofar as they do not depart from the spirit and scope of the present invention.

SUMMARY OF THE INVENTION

The device herein disclosed and described provides an apparatus especially well adapted to hold water-resistant film and digital cameras, constrained in a cavity engaged to the user, when the user occupies a marine environment.

In a particularly preferred mode, the device features a case which employs a bayonet mount having a female portion that is engageable to a male component that is engageable upon the exterior of a wetsuit. In this fashion the case is easily and quickly engaged or disengaged to the chest area of the wetsuit where it may be used to hold the camera.

The case is adapted in dimension to accommodate a digital or film camera. It has two features that independently or combined, make the device especially useful and convenient for use in the rough marine environment. The case employs a pair of stiff sidewalls engaged in parallel by an elastic strip which forms an edgewall on three sides. An aperture formed in one end provides for access to the interior cavity defined by the area between the aperture, the two sidewalls and the edge wall.

This aperture and the construction of the device are especially well adapted for easy insertion and removal of a camera from the interior cavity by the provision of two components adjacent to the aperture. First, one of the sidewalls adjacent to the aperture and positioned to be away from the user's body is longer than the other. This longer sidewall defines an overhang or lip which provides a means to guide the camera into the cavity, without looking at the device, when the shorter sidewall is engaged to the body by the bayonet mount. Second, a means to securely maintain the camera in the interior cavity, without closing the apertures, is provided by a pair of opposing ribs engaged to the sidewalls adjacent to the aperture. These projecting ribs, biased toward each other by the biased sidewalls, narrow the interior cavity adjacent to the aperture which forms a barrier that prevents the camera falling out of the interior cavity or from being removed, unless a camera tether is pulled with sufficient force to overcome the biasing of the elastic sidewalls separating the two ribs as they ride on the exterior of the camera on its way out.

Insertion is accomplished in the reverse where the distal end of the camera is pushed into the interior cavity behind the lip by application of sufficient force to overcome the bias of the elastic and thereby push the two ribs apart. In some cases on insertion, the ribs riding on the exterior of the camera will act as a squeegee to removed dirt and debris.

The opposing sidewalls are spaced to accommodate the width of the camera and the employment of elastic edge walls allows for the formed interior cavity to be adaptable to different sized cameras while the two ribs adjacent to the aperture will still impair the camera inserted, no matter what the width, from falling out or being removed without being pulled.

As noted, also included in the preferred mode of the device is a unique bayonet mount on the exterior of one sidewall. The mount is adapted to engage a mating mount that is engaged to the clothing or wetsuit worn by the user. Engagement requires the case to be rotated 90 degrees to align the mounts and then rotate back with gravity to maintain the engagement. Optionally, but probably wise, a reeled tether, biased to retract, is engaged to the camera and the case, as a safety precaution. While the camera is unlikely to get past the biased lips at the aperture, once out of the interior cavity in a rough marine environment, the user is liable to drop it. The biased tether will protect the camera from loss if such should occur.

With respect to the above description of the preferred modes of the user wearable camera case, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

DETAILED DESCRIPTION OF THE PREFERRED EMBODIMENTS OF THE INVENTION

Figures 1, 2, 3:
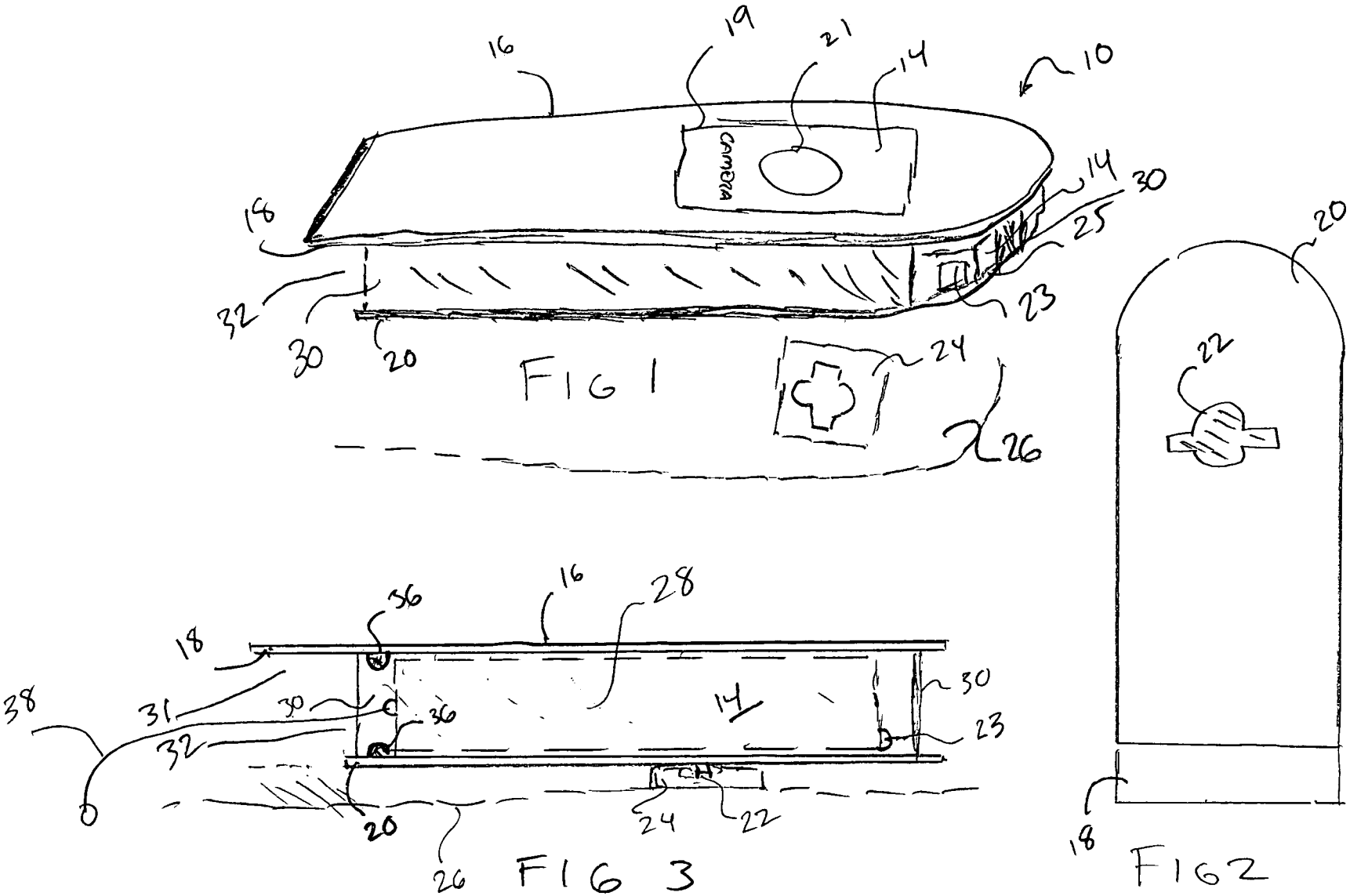
FIG. 1 depicts a perspective view of the disclosed device above a mount component adapted to engage a second mount component engaged to the exterior of the shorter sidewall.
FIG. 2 is a bottom view of the device showing the shorter sidewall with mount component thereon.
FIG. 3 depicts a slice through FIG. 1 showing the interior cavity formed between the two sidewalls and the two opposing ribs for restraining the camera in the interior cavity which is placed adjacent to the aperture providing communication to the internal cavity.

Referring now to the drawings, FIGS. 1-3 depict the disclosed device 10 for storing or holding a camera 14 in an aquatic environment occupied by the user such as a surfer in the ocean. The device 10 features a case 16 formed by a first sidewall 18 and shorter second sidewall 20. On the exterior surface of the second sidewall 20 is positioned a first mount component 22 which is adapted to engage a second mount component 24 which would be attached to the user such as by attachment to a wetsuit, or to a belt, or other clothing worn by the user. Using the mount components 22 and 24, the case 16 may be easily engaged or disengaged to the wetsuit 26 and remain attached to hold the camera 14 therein.

An interior cavity 28 is formed between the stiff first sidewall 18 and second sidewall 20 and an elastic edge wall 30 communicating between the two sidewalls and forming a side edge along three sides of the case 16. In a particularly preferred mode of the device 10, communicating through the first sidewall 18 is a window 19 positioned in to be in a registered engagement with the camera 14 such that the lens 21 of the camera 14 can be situated to point through the window 19. This will allow the user to take photos while the camera is in an engaged position inside the interior cavity 28 by depressing the camera 14 activation switch 23 which would be positioned in a gap 25 in the edgewall 30 holding the two sidewalls together. Or, since as noted the edgewall 30 is elastic, and a majority of camera activation buttons 23 are on the sides of the camera 14, the button may be pressed by deflection of the edgewall 30 to take a picture or video while the camera 14 is engaged within the interior cavity.

Of course the device 10 provides greatly improved camera storage without the window; however, when used in an aquatic environment, the user may wish not to dislodge the camera from the interior cavity 28 so the window increases the utility of the device 10. This window for the lens 21 also would allow positioning of the camera 14 to take video while being worn by the user which would also be especially useful when a surfer is riding a wave to render to the camera 14 the view the user sees while surfing.

Access to the interior cavity 28 is provided by an aperture 32 formed in one end. The aperture 32 is adapted to provide access to the interior cavity 28 defined by the area between the aperture 32, the two sidewalls 18 and 20, and the edgewall 30.

The device 10 provides the user with great utility by providing a secure storage for a camera 14 yet easy insertion and removal of a camera 14 from the interior cavity 28 through the employment of two components adjacent to the aperture 32. A first such component is provided by a means to funnel or guide the camera 14 through the aperture 30 and into the interior cavity 28 by the overhang 31 or lip portion provided by the longer first sidewall 18 spaced away from the user's body or clothing 26 when the case 16 is engaged to the user with the mounts. This means to guide the camera into the cavity 28 allows the user to easily insert the camera 14 into the internal cavity without looking by sliding the camera under the overhang 32 and pushing it into the internal cavity 28.

Means to securely maintain the camera 14 in the interior cavity 28 with no closure on the aperture 32 is provided by at least one, and preferably a pair of opposing projections in the form of ribs 36 engaged to the sidewalls adjacent to the aperture 30. The two ribs 36 project from interior surfaces of the two sidewalls and are biased toward each other by the biased sidewalls 18 and 20 and the elastic edgewall 30 engaged to the sidewalls. The projecting ribs 36 thus effectively narrow the interior cavity 28 immediately adjacent to the aperture 30 and defined an aperture width less than the gap between the two sidewalls thereby defining a barrier as a means to prevent the camera 14 falling out of the interior cavity 28 or from being removed. This aperture width may be increased to allow removal of the camera by pulling on the camera 14 with the fingers or pulling on a camera tether 38 with sufficient force to stretch and overcome the biasing of the elastic edgewall 30 which biases the two sidewalls and hence, the engaged ribs 36, toward each other.

Storage of the camera 14 in the interior cavity is accomplished by forcing the distal end of the camera 14 behind the lip or overhang 31 and pushing with sufficient force to overcome stretch and overcome the bias of the elastic in the edge wall 30 and thereby increase the size of the aperture width by forcing two curved ribs 36 away from each other during traverse of the camera therebetween.

The opposing sidewalls 18 and 20 are spaced to accommodate the thickness of the camera 14 and using the elastic edgewalls 30 provides a means to adapt the width of the interior cavity to accommodate different width cameras 14. However, the rib or ribs 36 positioned adjacent to the aperture will prevent the camera 14 from falling out of the interior cavity when the two sidewalls rest against the exterior of the camera 14. Optionally, a biased reel engages a first end of a retractable tether 38 and is adapted to pull upon the distal end of the tether 38 as a safety precaution. When the user has removed the camera 14 from the interior cavity 28 for a quick shot, the tether 38, threaded through the interior cavity 28 or just engaged to the camera 14 directly, provides a means to tether the camera 14 to the user or the device and prevent loss if dropped. Threading the retractable tether 38 through the gap in the edgewall 30 and to the camera 14 will tend to pull the camera 14 back into the interior cavity when returning it thereto.

Although the invention has been herein disclosed and described with respect to particular embodiments thereof, it should be realized that various changes and modifications may be employed to the method and apparatus for secure storage of a camera in an aquatic environment without departing from the spirit and scope of the invention. While the invention as shown in the drawings and described in detail herein discloses arrangements of elements of particular construction and configuration for illustrating preferred embodiments of structure and method of operation of the present invention, it is to be understood, however, that elements of different construction and configuration and other arrangements thereof, other than those illustrated and described, may be employed in accordance with the spirit of this invention. Any and all such changes, alternations and modifications, as would occur to those skilled in the art, are considered to be within the scope of this invention as broadly defined in the appended claims.

What is claimed is:

1. A camera storage apparatus for engagement to a user, comprising:

a case, said case having a first sidewall having an interior surface, a second sidewall having an inside surface, and an elastic edgewall communicating therebetween defining a gap between said first sidewall and said second sidewall;

an aperture communicating with an interior cavity at a first end of said case;

at least one projection engaged to one of said interior surface and said inside surface, and extending to a distal end;

an aperture width defined by a distance between said distal end and a respective opposing said inside surface or said interior surface;

said interior cavity defined by the area in-between said interior surface of said first sidewall, said inside surface of said second sidewall, said edgewall and said projection;

said aperture width being less than a thickness of a camera positioned within said interior cavity thereby providing means to prevent an exit of said camera from said interior cavity through said aperture;

a stretching of said edgewall adjacent to said aperture providing means to increase said aperture to an enlarged width equal to or more than said thickness and allow said exit of said camera from said interior cavity past said aperture; and said elastic edgewall providing means to increase said gap to accommodate cameras having a thickness in excess of said gap.

2. The camera storage apparatus of claim 1 additionally comprising:

said first sidewall having a length defined by a first distance between said first end of said case and an opposite end;

said second sidewall having a second length defined by a second distance between said first end of said case and said opposite end;

said first distance being more than said second distance thereby defining a lip portion of said first sidewall extending past said first end of said second sidewall;

means to engage said second sidewall to the clothing of a user; and said lip portion defining a guide into said aperture for said camera placed between said lip and said clothing during an insertion of said camera through said aperture into said interior cavity.

3. The camera storage apparatus of claim 1 additionally comprising:

a second projection engaged to the other of said interior surface or said inside surface than that of said at least one projection and substantially aligned therewith;

said second projection extending to a second distal end; and said aperture width defined by a distance between said distal ends of said at least one projection and said second projection.

4. The camera storage apparatus of claim 2 additionally comprising:

a second projection engaged to the other of said interior surface or said inside surface than that of said at least one projection and substantially aligned therewith;

said second projection extending to a second distal end; and said aperture width defined by a distance between said distal ends of said at least one projection and said second projection.

5. The camera storage apparatus of claim 1 additionally comprising:

said first sidewall having a window formed therein communicating with said interior cavity; and said window positioned to surround a lens on said camera engaged within said interior cavity whereby said camera can be operated while engage in said interior cavity by a depression of an activation switch on said camera through said gap in or deflection of said edgewall.

6. The camera storage apparatus of claim 2 additionally comprising:

said first sidewall having a window formed therein communicating with said interior cavity; and said window positioned to surround a lens on said camera engaged within said interior cavity whereby said camera can be operated while engage in said interior cavity by a depression of an activation switch on said camera through said gap in or deflection of said edgewall.

7. The camera storage apparatus of claim 3 additionally comprising:

said first sidewall having a window formed therein communicating with said interior cavity; and said window positioned to surround a lens on said camera engaged within said interior cavity whereby said camera can be operated while engage in said interior cavity by a depression of an activation switch on said camera through said gap in or deflection of said edgewall.

8. The camera storage apparatus of claim 4 additionally comprising:

said first sidewall having a window formed therein communicating with said interior cavity; and said window positioned to surround a lens on said camera engaged within said interior cavity whereby said camera can be operated while engage in said interior cavity by a depression of an activation switch on said camera through said gap in or deflection of said edgewall.

9. The camera storage apparatus of claim 1 additionally comprising:

a tether engaged to said camera and extending through said aperture when said camera is engaged within said interior cavity;

said tether providing means to pull said camera and impart a force to said at least one projection to impart a stretching to said edgewall thereby increasing said aperture width to allow removal of said camera.

10. The camera storage apparatus of claim 2 additionally comprising:

a tether engaged to said camera and extending through said aperture when said camera is engaged within said interior cavity;

said tether providing means to pull said camera and impart a force to said at least one projection to impart a stretching to said edgewall thereby increasing said aperture width to allow removal of said camera.

11. The camera storage apparatus of claim 3 additionally comprising:

a tether engaged to said camera and extending through said aperture when said camera is engaged within said interior cavity;

said tether providing means to pull said camera and impart a force to said at least one projection to impart a stretching to said edgewall thereby increasing said aperture width to allow removal of said camera.

12. The camera storage apparatus of claim 4 additionally comprising:

a tether engaged to said camera and extending through said aperture when said camera is engaged within said interior cavity;

said tether providing means to pull said camera and impart a force to said at least one projection to impart a stretching to said edgewall thereby increasing said aperture width to allow removal of said camera.

13. The camera storage apparatus of claim 5 additionally comprising:

a tether engaged to said camera and extending through said aperture when said camera is engaged within said interior cavity;

said tether providing means to pull said camera and impart a force to said at least one projection to impart a stretching to said edgewall thereby increasing said aperture width to allow removal of said camera.

14. The camera storage apparatus of claim 6 additionally comprising:

a tether engaged to said camera and extending through said aperture when said camera is engaged within said interior cavity;

said tether providing means to pull said camera and impart a force to said at least one projection to impart a stretching to said edgewall thereby increasing said aperture width to allow removal of said camera.

15. The camera storage apparatus of claim 7 additionally comprising:

a tether engaged to said camera and extending through said aperture when said camera is engaged within said interior cavity;

said tether providing means to pull said camera and impart a force to said at least one projection to impart a stretching to said edgewall thereby increasing said aperture width to allow removal of said camera.

16. The camera storage apparatus of claim 8 additionally comprising:

a tether engaged to said camera and extending through said aperture when said camera is engaged within said interior cavity;

said tether providing means to pull said camera and impart a force to said at least one projection to impart a stretching to said edgewall thereby increasing said aperture width to allow removal of said camera.

17. The camera storage apparatus of claim 9 additionally comprising:

said tether engaged to said camera at a first end and to a biased reel at a second end.

18. The camera storage apparatus of claim 10 additionally comprising:

said tether engaged to said camera at a first end and to a biased reel at a second end.

19. The camera storage apparatus of claim 11 additionally comprising:

said tether engaged to said camera at a first end and to a biased reel at a second end.

20. The camera storage apparatus of claim 12 additionally comprising:

said tether engaged to said camera at a first end and to a biased reel at a second end.

* * * * *